US006789337B2

(12) United States Patent
Mallaghan

(10) Patent No.: US 6,789,337 B2
(45) Date of Patent: Sep. 14, 2004

(54) SCREENING APPARATUS

(76) Inventor: Lee Mallaghan, Carpenterstown Road, Castleknock, Dublin 15 (IE)

( * ) Notice: Subject to any disclaimer, the term of this patent is extended or adjusted under 35 U.S.C. 154(b) by 555 days.

(21) Appl. No.: 09/409,614

(22) PCT Filed: Apr. 2, 1998

(86) PCT No.: PCT/IE98/00025

§ 371 (c)(1),
(2), (4) Date: Oct. 1, 1999

(87) PCT Pub. No.: WO98/44206

PCT Pub. Date: Oct. 8, 1998

(65) Prior Publication Data

US 2002/0124441 A1 Sep. 12, 2002

(30) Foreign Application Priority Data

Apr. 2, 1997 (IE) ..... S970245

(51) Int. Cl.[7] ..... E02F 3/96; B07B 1/49

(52) U.S. Cl. ..... 37/403; 209/421; 209/418; 209/419; 209/420; 209/325; 414/912

(58) Field of Search ..... 37/468, 403, 405, 37/408, 409, 410, 142.5, 904; 209/418, 419, 420, 421, 325; 414/912, 723

(56) References Cited

U.S. PATENT DOCUMENTS 3,731,975 A * 5/1973 Lindelof ..... 299/9
3,813,125 A * 5/1974 Sims et al. ..... 299/7
4,035,022 A * 7/1977 Hahlbrock et al. ..... 299/8
4,113,023 A * 9/1978 Baskett ..... 37/305 X
4,202,155 A * 5/1980 Stewart ..... 56/9
4,364,434 A * 12/1982 Erholm ..... 37/305 X
4,633,602 A * 1/1987 Layh et al. ..... 37/142.5 X
4,871,213 A * 10/1989 Hanson ..... 299/64
4,912,862 A * 4/1990 Bishop et al. ..... 37/142.5
4,955,756 A * 9/1990 Klamar ..... 405/179
5,084,991 A * 2/1992 Cronk, Jr. ..... 37/142.5
5,092,657 A * 3/1992 Bryan, Jr. ..... 37/189
5,120,433 A * 6/1992 Osadchuk ..... 37/304 X
5,261,171 A * 11/1993 Bishop ..... 37/142.5
5,479,726 A * 1/1996 Bishop ..... 37/142.5
5,540,003 A * 7/1996 Osadchuk ..... 37/142.5
5,741,087 A * 4/1998 Osadchuk ..... 37/142.5 X
6,138,837 A * 10/2000 Santa Cruz et al. ... 37/142.5 X

* cited by examiner

*Primary Examiner*—Victor Batson
(74) *Attorney, Agent, or Firm*—Emery L. Tracy

(57) ABSTRACT

A screening apparatus is removably connected to a prime mover having an excavating bucket or loading shovel. The screening apparatus includes a material feed conveyor that feeds material to a screening device. A mounting mechanism and associated adjustment mechanism are used to detachably and movably mount the screening apparatus to support structure on the prime mover, with the conveyor being located adjacent the bucket or loading shovel for receiving unscreened material into the screening apparatus from the bucket or loading shovel during use.

17 Claims, 4 Drawing Sheets

SCREENING APPARATUS

The present invention relates to improvements to screening apparatus, particularly mobile screening apparatus which can be transported from site to site and can be used to screen material such as soil, sand, gravel, rubble and refuse. A particularly effective screening apparatus is the screening apparatus known as "Viper Sizer 122" which is manufactured and sold by Viper International Limited. It has a vibrating screen box mounted on a frame located between a fifth wheel coupling and rear wheels and has a stock pile conveyor extending from the centre of the apparatus rearwardly over the wheels for use to form a stock pile of material which is being screened by the vibrating screen box.

This type of apparatus has proved so popular that a smaller version known as a "Mini-Sizer" has been produced which has many of the advantages of the larger machine but which is still too expensive for many smaller operations such as small quarries, golf and sports clubs.

The main disadvantage of the prior art apparatus is that while the screening apparatus is effective, material has to be brought to the apparatus by an excavator, a loader with a shovel or the like. Therefore, as the regulatory authorities insist more and more upon compulsory screening of all rubble and refuse before it is accepted at disposal sites, it is necessary for any demolition job to have two pieces of apparatus on site at any one time, i.e. the screening apparatus and an excavator or loading shovel for bringing the material to be screened to the screening apparatus which although is located on site, cannot easily be moved during the actual screening operation.

The object of the invention is to alleviate the disadvantages associated with the prior art apparatus, particularly for small site work.

Accordingly, the present invention provides a screening apparatus which is removably connectable to a prime mover, having an excavating bucket or loading shovel which can be used to load unscreened material into the screening apparatus mounted on the prime mover.

Advantageously, material conveying means are removably attached to the prime mover whereby material may be loaded onto the conveyor by means of the loading or excavating bucket. The conveying means conveys the material to the screening apparatus mounted on the prime mover.

Conveniently, the screening apparatus may be one of a number of screening devices such as a vibrating screen or trommel screen.

Conveniently, the prime mover is a back-hoe loader of the type having an arm extending rearwardly with an excavating shovel and a pair of arms extending forwardly of the prime mover and for retaining a loading shovel.

Preferably, the front arms of the prime mover are used to support the screening apparatus which then can be elevated to the particular height required.

Additional jacking elements can be attached to the prime mover in order to stabilise the prime mover during any screening mode of the operation.

Alternatively, the present invention provides a screening apparatus in which the prime mover is a tracked excavating machine and the apparatus is mounted to one side of the tracked excavating machine.

Advantageously, the prime mover is a tracked excavating machine and the apparatus is centrally mounted on the tracked excavating machine, with the cab and engine of the excavating machine being mounted on a pedestal to allow a central conveyor of the apparatus to pass between the cab and engine and the tracks.

Conveniently, the screening apparatus is mounted on supporting framework extending to the rear of the excavating machine, with one or more further conveying means being provided to convey screened material from the apparatus.

Preferably, the further conveying means comprises a rear conveyor and one or more side conveyors.

Preferably, the hydraulically powered lifting means are provided for varying the height and angle of the conveying means and screening means.

The invention will hereinafter be more particularly described with reference to the accompanying drawings, which illustrate by way of example only, four specific embodiments of the invention. In the drawings.

Figure 1:
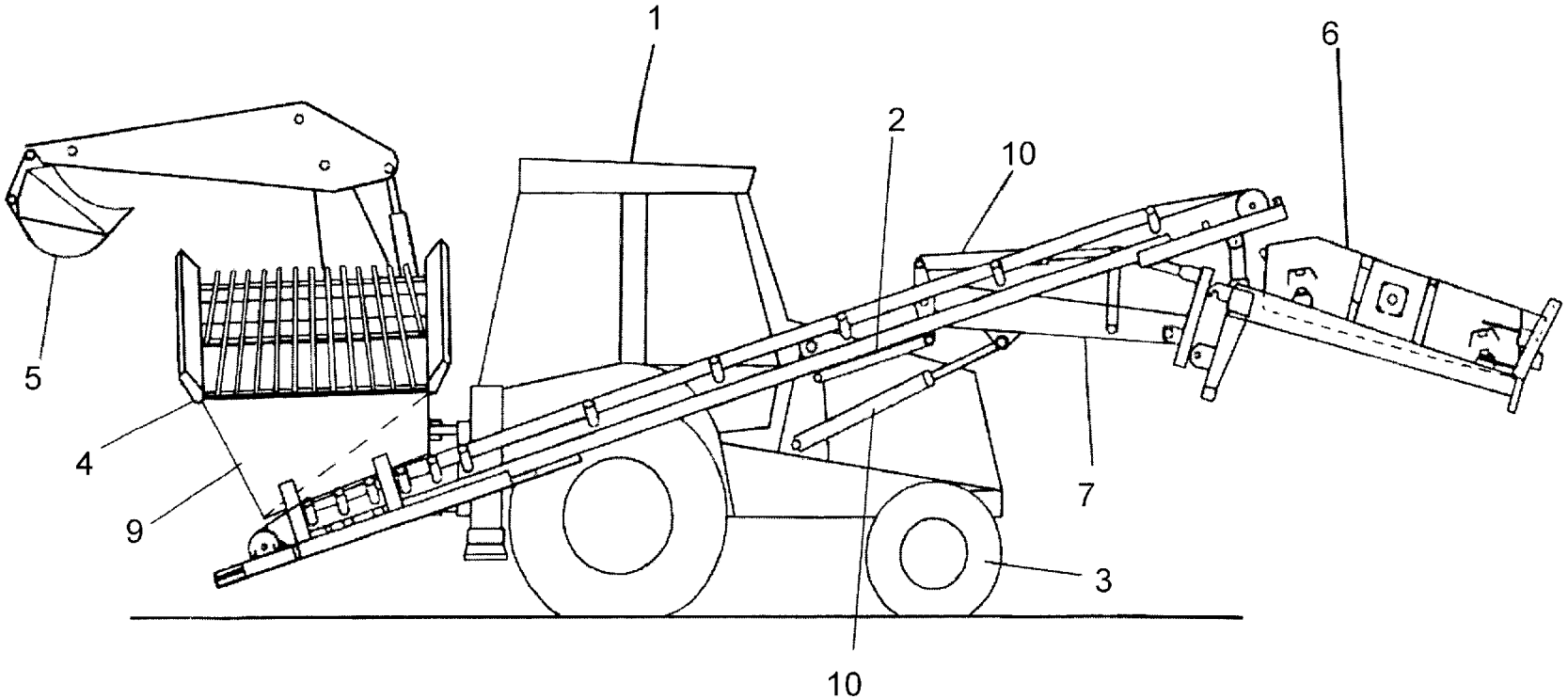
FIG. 1 is a side view of a first embodiment of the apparatus attached to one side of a back-hoe loader.

Referring to the drawings and initially to FIG. 1, screening apparatus 6 is carried on front arms 7 of the excavator 1 by means of quick release couplings (not shown) to enable the screening apparatus to be quickly attached and removed as required. Material to be screened is fed to the screening apparatus 6 by means of a conveyor 2 attached to the side of the back-hoe excavator 1. The excavating shovel 5 is used to load material to be screened onto the inclined grid 4 at the lower end of the conveyor 2 to allow the material to be conveyed upwardly to the screening apparatus. Oversized material passes over the grid 4 and falls to the side of the apparatus. Material smaller than the grid 4 passes through the grid into hopper 9 onto the belt 2. The hopper 9 has an adjustable door to regulate the flow of material. The material from the conveyor belt 2 drops onto the screening apparatus 6, the height and angle of which can be altered using the hydraulic arms 10. The screening apparatus 6 is a vibrating screen box driven by a hydraulic motor.

The excavator 1 can move on wheels 3 on site from one particular pile of material to another and the material to be screened can be easily scooped onto the conveyor belt by means of the bucket 5. The screened material may fall directly to the ground or onto a stock piling conveyor located adjacent the screening apparatus 6. When it is desired to transport the device by road, the conveyor 2 can be folded laterally inwardly inside the wheel base of the excavator 1. It may also be folded longitudinally as is common in transportation of conveyors. The hydraulic motors of the conveyor and the screening apparatus 6 may be powered from the hydraulic system of the excavator 1.

Figure 3:
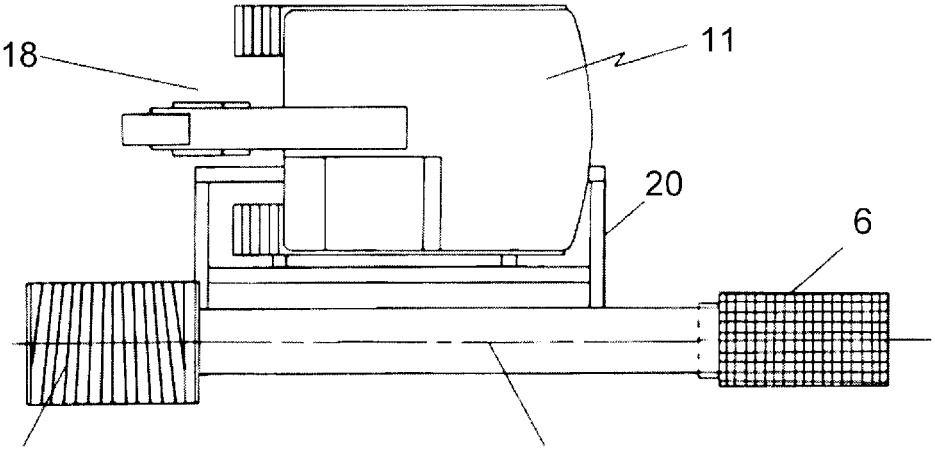
FIG. 3 is a plan view of the second embodiment of the apparatus.
Figure 2:
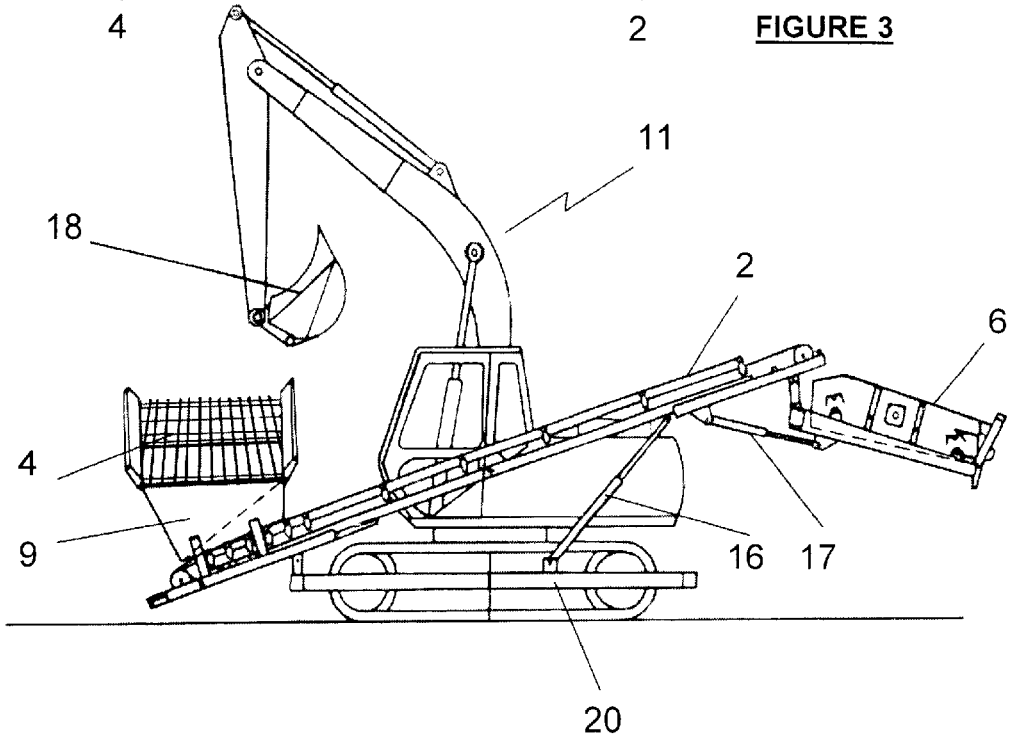
FIG. 2 is a side view of a second embodiment of the apparatus of the invention attached to one side of a tracked excavating machine.

The second embodiment shown in FIGS. 2 and 3, is a somewhat similar arrangement to that shown in FIG. 1, except that the entire assembly is mounted on a tracked excavating machine on a support structure 15. Conveyor 2 is used to convey the material to the screening apparatus 6 as in the first embodiment. Like parts are given like numerals. The angle and tilt of the conveyor 2 and screening apparatus 6 can be varied by hydraulic cylinder 16 mounted between the conveyor 2 and the support structure 20 and a hydraulic cylinder 17 mounted between the conveyor 2 and screening apparatus 6. In this embodiment, the excavating bucket 18 is used to load the material onto the sloped grid 4 and again the apparatus may be easily disassembled from the excavating machine or may be moved into a transport mode for transportation purposes.

Figure 5:
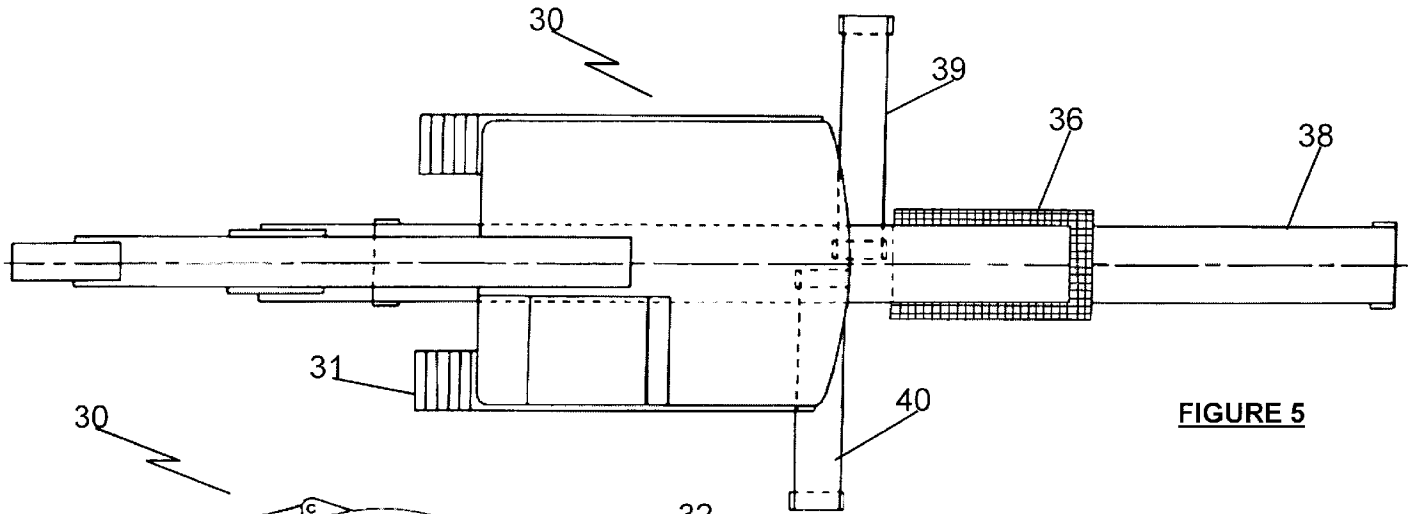
FIG. 5 is a plan view of the third embodiment.
Figure 4:
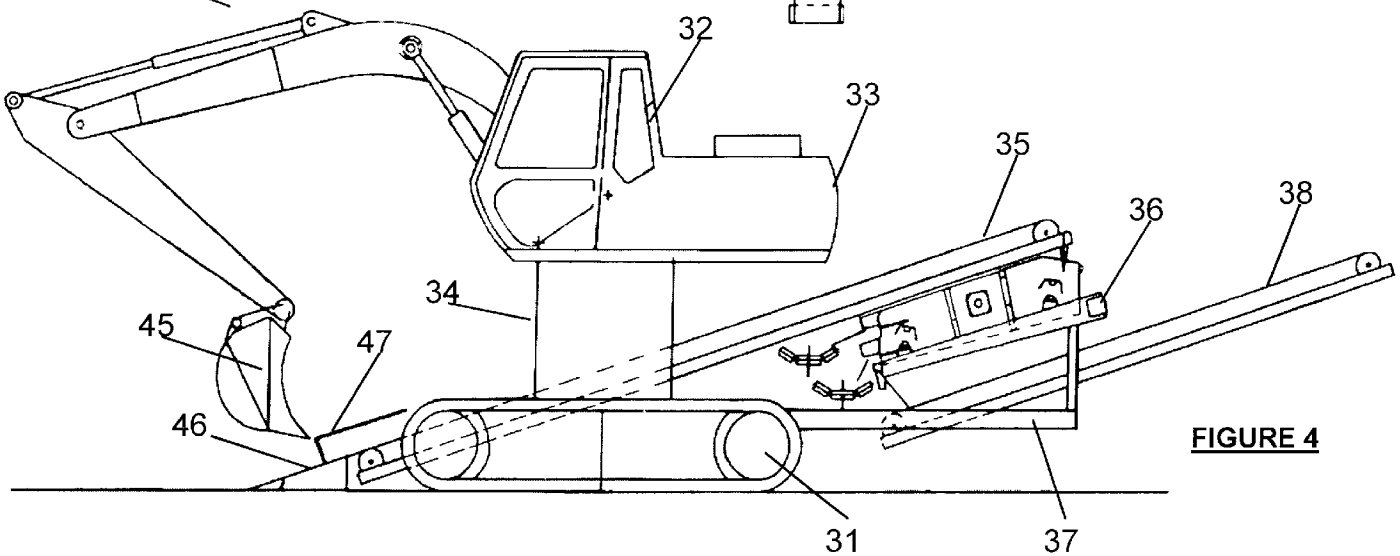
FIG. 4 is a side view of a third embodiment of the apparatus of the invention centrally mounted on a tracked excavating machine.

The third embodiment shown in FIGS. 4 and 5 is centrally mounted on a crawler excavating machine 30 mounted on tracks 31. The cab 32 and engine 33 of the excavating machine 30 are on a pedestal 34 raised above the excavating tracks 31. A central conveyor 35 extends between the pedestal 34 so as to convey material to be screened from the front of the machine 30 to the rear of the machine where a screening apparatus 36 is located supported by a framework 37. Extending from the screening apparatus 36 are a rear conveyor 38 and two side conveyors 39 and 40. The material to be screened is loaded onto the conveyor 35 by means of shovel 45 of the excavating machine 30. A protective plate 46 and guide plate 47 are provided at the base of the central conveyor 35. The material travels up the central conveyor 35 and drops into the screening apparatus 36 where it is segregated into three different sizes or grades. The three grades of material are discharged by means of the rear conveyor 38 and two side conveyors 39 and 40.

As the third embodiment is a very balanced arrangement it can take a very high output of product and yet is a highly mobile machine as the excavating machine 30 can move on the tracks 31.

Figure 7:
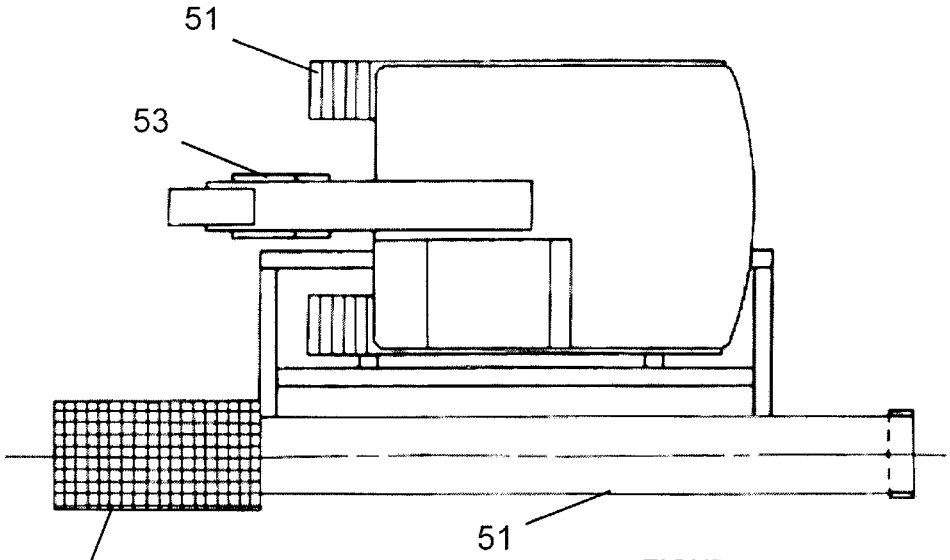
FIG. 7 is a plan view of the fourth embodiment.
Figure 6:
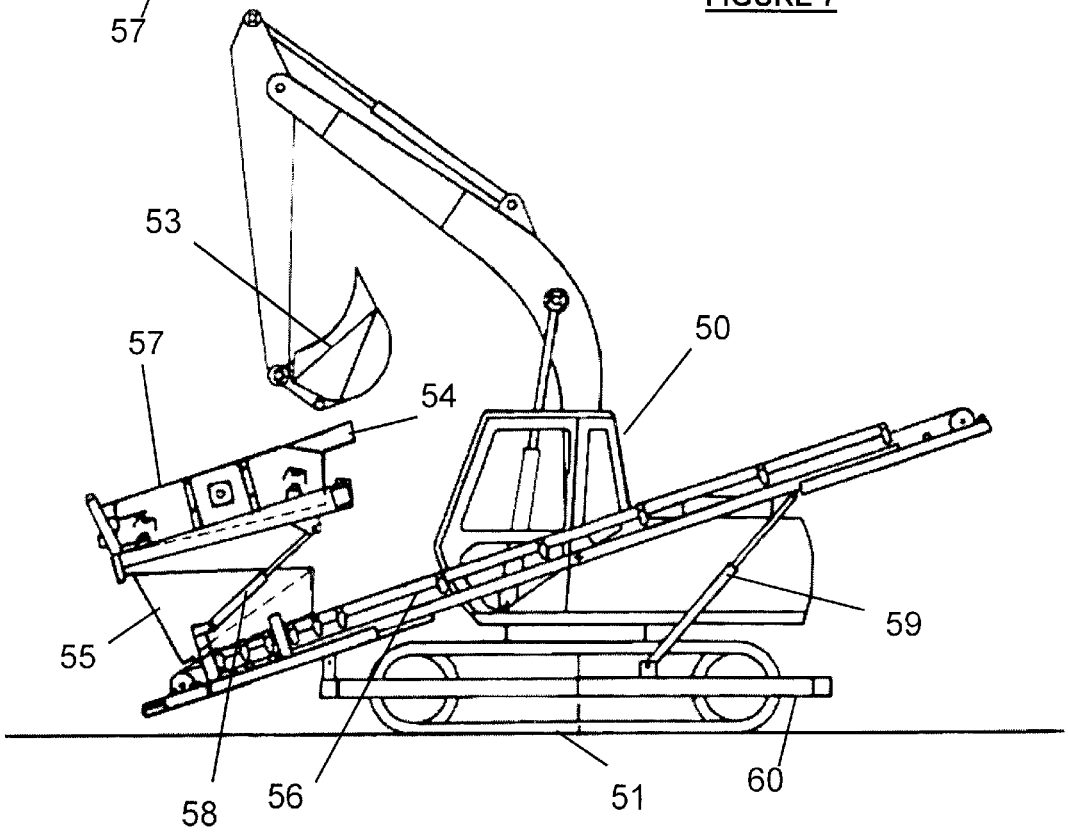
FIG. 6 is a side view of a fourth embodiment of an apparatus of the invention.

The fourth embodiment shown in FIGS. 6 and 7, is attached to one side of an excavating machine 50 which is movable on tracks 51. An excavation bucket 53 is used to drop material onto a spreader plate 54 of vibrating screening apparatus 57. The screened material drops onto hopper 55 and then transfers onto conveyor 56 which conveys the screened material to be stockpiled or transferred to another conveyor (not shown). The height and angle of the conveyor 56 can be adjusted using hydraulic cylinder 59 which extends between supporting framework 60 and the conveyor 56. The height and angle of the screening apparatus 57 can be adjusted by means of the hydraulic ram 58 which is located between the screening apparatus 57 and the conveyor 56.

It will of course be understood that the invention is not limited to the specific details described herein, which are given by way of example only, and that various modifications and alterations are possible within the scope of the invention as defined in the appended claims.

What is claimed is:

1. A screening apparatus for use with a prime mover of the type having an excavating bucket or loading shovel, the apparatus having a material feed conveyor and an associated screening device characterized in that the apparatus incorporates a mounting mechanism and associated adjustment mechanism formed for detachably and movably mounting the apparatus to a support structure of the prime mover with the conveyor adjacent the bucket or loading shovel and receiving unscreened material into the screening apparatus mounted on the prime mover from the bucket or loading shovel during use.

2. A screening apparatus as claimed in claim 1 in which the adjustment mechanism is hydraulically powered and formed for varying the height and angle of the conveyor and the screening device.

3. A screening apparatus as claimed in claim 1 or claim 2, in which the screening apparatus is a screening device selected from the group consisting of a vibrating screen and a trommel screen.

4. A screening apparatus as claimed in claim 1, in which the prime mover is a back-hoe loader of the type having an arm extending rearwardly with an excavating shovel and a pair of arms extending forwardly of the prime mover wherein the mounting mechanism is adapted to position the screening apparatus on the front arms of the prime mover to support the screening apparatus, the mounting mechanism being movable to allow the screening apparatus, so supported to be elevated and tilted to the particular height and angle required by the arms.

5. A screening apparatus as claimed in claim 4, in which jacking elements are attached to the prime mover in order to stabilise the prime mover during any screening mode of the operation.

6. A screening apparatus as claimed in claim 1, in which the prime mover is a tracked excavating machine and the movable mounting mechanism is adapted for movable detachment to one side of the tracked excavating machine.

7. A screening apparatus as claimed in claim 1, in which the prime mover is a tracked excavating machine and the apparatus is centrally mounted on the tracked excavating machine, with the cab and engine of the excavating machine being mounted on a pedestal to allow a central conveyor of the apparatus to pass between the cab and engine and the tracks.

8. A screening apparatus as claimed in claim 7, in which the screening apparatus is mounted on supporting framework extending to the rear of the excavating machine, with one or more further conveying means being provided to convey screened material from the apparatus.

9. A screening apparatus as claimed in claim 8 in which the further conveying means comprises a rear conveyor and one or more side conveyors.

10. A screening apparatus for use with a prime mover of the type having an excavating bucket, the screening apparatus comprising:

(a) a screening device located within reach of the excavating bucket and receiving unscreened material from the bucket during use;

(e) a material discharge conveyor for conveying screened material;

(f) a mounting mechanism and associated adjustment mechanism for detachably mounting the apparatus to a support structure of the prime mover; and (g) the adjustment mechanism being hydraulically powered and operable to vary the height and angle of the screening device and the discharge conveyor.

11. The screening apparatus as claimed in claim 10, wherein the screening apparatus is a screening device selected from the group consisting of a vibrating screen and a trommel screen.

12. The screening apparatus as claimed in claim 10, wherein the prime mover is a tracked excavating machine.

13. The screening apparatus as claimed in claim 12, wherein the screening apparatus is mounted on supporting framework extending to the rear of the excavating machine with at least one further conveying means being provided to convey screened material from the apparatus.

14. A screening apparatus for use with a prime mover of the type having an excavating bucket or loading shovel, the apparatus having a material feed conveyor and an associated screening device characterized in that the apparatus incorporates a mounting mechanism and associated adjustment mechanism formed for detachably and movably mounting the apparatus to a support structure of the prime mover with the conveyor adjacent the bucket or loading shovel for receiving unscreened material into the screening apparatus mounted on the prime mover and further in which the prime mover is a tracked excavating machine and the apparatus is centrally mounted on the tracked excavating machine, with the cab and engine of the excavating machine being mounted on a pedestal to allow a central conveyor of the apparatus to pass between the cab and engine and the tracks.

15. A screening apparatus as claimed in claim 14 in which the screening apparatus is mounted on supporting framework extending to the rear of the excavating machine with one or more conveying means being provide to convey screened material from the apparatus.

16. A screening apparatus as claimed in claim 15 in which the further conveying means comprises a rear conveyor and one or more side conveyors.

17. A screening apparatus as claimed in claim 15 in which hydraulically powered lifting means are provided for varying the height and angle of the conveying means and screening means.

* * * * *